United States Patent [19]

Rigsby et al.

[11] Patent Number: 4,798,076

[45] Date of Patent: Jan. 17, 1989

[54] NIPPLE FORMING APPARATUS

[75] Inventors: Donald R. Rigsby, Jenison; James R. Dehlinger, Ada; David A. Passmore, Wayland, all of Mich.

[73] Assignee: Benteler Industries, Inc., Grand Rapids, Mich.

[21] Appl. No.: 160,780

[22] Filed: Feb. 26, 1988

[51] Int. Cl.[4] ..... B21D 31/00; B21D 22/00

[52] U.S. Cl. ..... 72/352; 29/157 T; 72/370

[58] Field of Search ..... 29/157 A, 157 T; 72/352, 354, 358, 359, 367, 370, 377, 379, 465, 466

[56] References Cited

U.S. PATENT DOCUMENTS

| | | | |
|---|---|---|---|
| 354,879 | 12/1886 | Youngs . | |
| 596,770 | 1/1898 | Chinningworth . | |
| 656,425 | 8/1900 | Schilling . | |
| 1,892,712 | 1/1933 | Taylor . | |
| 2,910,897 | 11/1959 | Huet | 29/544 |
| 3,216,092 | 11/1965 | Arbogast | 29/157 |
| 3,238,605 | 3/1966 | Hills | 29/157 |
| 3,468,147 | 9/1969 | Davies | 29/157 |
| 3,535,909 | 10/1970 | Latham | 29/157 |
| 3,712,097 | 1/1973 | Verkaik et al. | 29/157 |
| 3,867,831 | 2/1975 | Moshnin et al. | 72/367 |
| 4,051,704 | 10/1977 | Kimura | 72/58 |
| 4,083,219 | 4/1978 | Combes et al. | 72/379 |
| 4,246,772 | 1/1981 | Moshnin et al. | 72/370 X |
| 4,400,966 | 8/1983 | Eckold et al. | 72/367 |
| 4,676,088 | 6/1987 | Okada et al. | 29/157 |

FOREIGN PATENT DOCUMENTS

| | | | |
|---|---|---|---|
| 2814176 | 10/1978 | Fed. Rep. of Germany | 29/157 T |

*Primary Examiner*—E. Michael Combs

*Attorney, Agent, or Firm*—Price, Heneveld, Cooper, DeWitt & Litton

[57] ABSTRACT

The specification discloses extension nipple formation at acute angles on tubular engine exhaust manifold bodies for lap weld attachment of side runners. An articulated or single axis mandrel is inserted axially into the tubular body, each mandrel portion being in an angular body portion. Precut holes in the body are of oval shape. Laterally extensible forming dies are positioned in guide recesses in respective mandrel portions to be aligned with the precut holes and extensible at acute angles to the body and at an angle to each other. Drawing rods are extensible by transfer actuator cylinders into the dies where the rods are interlocked with the dies by rotary actuators. Power forming actuators then shift the rods and dies outwardly to form cylindrical nipples, the forming actuators temporarily overcoming the transfer actuators, and then returning the dies into the mandrel. The rods are then released from the dies and retracted, and the mandrel with dies withdrawn.

12 Claims, 7 Drawing Sheets

NIPPLE FORMING APPARATUS

BACKGROUND OF THE INVENTION

This invention relates to formation of lateral nipples on tubular stock, and particularly to forming nipples on configurated, stainless steel, engine manifold bodies, for cooperative interfit of the nipples with side runners.

In years past, engine manifolds were largely made of heavy cast construction. In recent years, technological developments have enabled manufacture of engine manifolds from stainless steel tubular stock. In so doing, the side members, called runners, are welded onto the main body, called the "log", around openings laser-cut into the body in accordance, for example, with the teachings of U.S. Pat. No. 4,644,128 issued Feb. 17, 1987. Typically, the body or log is of unusual configuration, having portions at angles to each other, while the runners are attached to and project laterally from these portions at various acute angles. If the runners are butt welded to the log, subsequent flexing and/or vibration of the runners during use can result in cracking at the welds. Moreover, exhaust turbulence is created at the juncture of the components, causing localized hot spots with concomitant stresses and potential joint failure.

While it would be advisable to have the runners lap welded into integral nipples protruding from the body, instead of butt welded to the body wall, the fact that the body is of stainless steel and therefore difficult to form, the fact that the body typically has a peculiar configuration, and the fact that the runners project at acute angles to the body have effectively limited this type of arrangement. Specifically, it has not been practical to properly form the necessary nipples on a production basis. One technique which has been proposed is to spin form nipples. However, this works only for nipples at 90 degrees to the body, on round holes, and is time consuming and considered too costly. Basically this technique is not practical for most stainless steel engine manifolds, which require runners at differing angles and extending from portions of the manifold at angles to each other.

Another technique employed to some extent has been to cause the mouth of each runner to be flared to extend over a considerable portion of the body around the precut opening in the body. However, this technique has disadvantages including potential localized hot spots caused by turbulence of hot exhaust gases flowing from the runners and striking the protruding body portions within the flared runner mouths. Hot spots tend to cause uneven stresses and subsequent failure, as is known.

SUMMARY OF THE INVENTION

This invention achieves dependable, practical nipple formation on tubular, stainless steel, exhaust manifold bodies of unusual configuration, at angles to each other. The invention enables formation of nipples at acute angles to the body to allow lap welded attachment of runners at angles to the body.

In practicing the invention, a mandrel, solid or articulated, and having laterally extensible forming dies, is inserted axially into the tubular body which is retained in a press; then drawing rods are extended by transfer actuators through precut body openings into an interlock relationship with the forming dies. Forming actuators then draw the dies out at angles to form cylindrical nipples, while overcoming the force of the transfer actuators. After the forming actuators return the dies to the mandrel, the transfer actuators disengage the drawing rods from the dies and retract the drawing rods, and the mandrel with dies is axially retracted from the body.

The novel apparatus is capable of accommodating stainless steel manifold components, even though the body of the manifold has a configuration with portions at an angle to each other. Moreover, the nipples can be formed around openings which are noncircular, even at acute angles to the body. The nipples in differing portions of the body are formed at angles to each other, in single piece or articulated mandrels depending upon the manifold's body configuration. When the intersections of the center lines of the nipples and the center line of the end of the tub lie in a straight line, it is sometimes feasible to use a straight mandrel. When the points do not lie on the same line, or there are bends between the points, it becomes necessary to provide points of articulation, allowing movement at one or more axes to accommodate the bends.

The drawing rods and forming dies have male and female couplers with a rotary interlock connection. The female member is preferably on the forming die, being an elongated slot having undercut shoulders adjacent thereto. The male member has an oblong cross section with tapered side walls for alignment with the slot when inserted, and a pair of shoulders cooperative with the undercut female shoulders when the male member is rotated by a rotary actuator to interlock the male shoulders with the female shoulders.

The forming actuators are preferably fluid cylinders which move in a dimension the same as the transfer actuators. The forming actuators have a shorter stroke at greater force than the transfer actuators to overcome the force of the transfer actuators during nipple formation.

The transfer actuator, the forming actuator and the rotary actuator for each forming die operate through a common rod or shaft to the male member. By means of this common shaft, therefore, the transfer actuator advances the male member through the opening in the manifold body and into the female member of the forming die, the rotary actuator rotates the shaft and male member to cause interlock, the forming actuator withdraws the shaft along with the die to form the nipple and then return the die, the rotary actuator reverses to release the die, and the transfer actuator reverses to withdraw the male member.

An articulated mandrel, supporting, retaining and guiding the forming dies, allows the dies to be in separate articulated portions of the mandrel while enabling the mandrel to be axially inserted by a mandrel actuator into the manifold body for alignment of the dies with respective precut openings in the body.

These and other objects, advantages and features of the invention will become apparent upon studying the following detailed description.

DESCRIPTION OF THE PREFERRED EMBODIMENT

The preferred embodiment of the invention will now be described with particular reference to the drawings.

Figure 1:
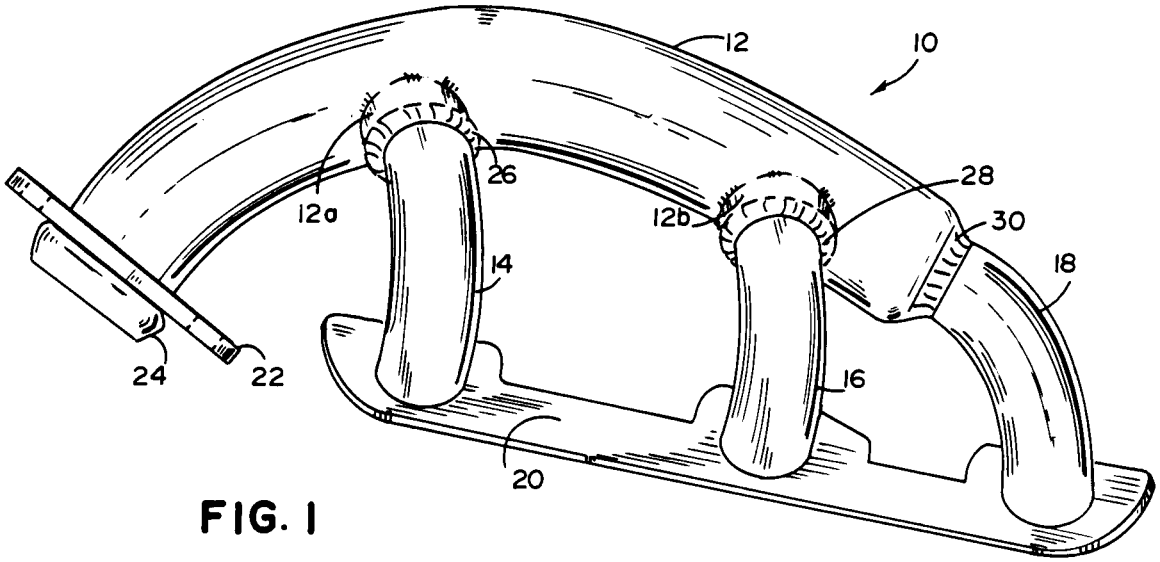
FIG. 1 is a perspective view of one type of exhaust manifold made according to this invention.

In FIG. 1, an exemplary manifold 10 is shown, such including a body 12, commonly called a "log", three runners 14, 16 and 18 all connected to the log and to a mounting plate 20 commonly called the inlet flange for attachment to an engine, and a conventional connector plate 22 commonly called an outlet flange behind the swaged end 24 of the body for connection to a conventional exhaust pipe. In a typical installation, inlet flange 20 will have holes (not shown) at desired locations for bolted attachment to the engine. In the particular example manifold depicted, runner 18 extends into the axial end of the curvilinear configurated body 12 opposite the exhaust outlet end 24.

Figure 7:
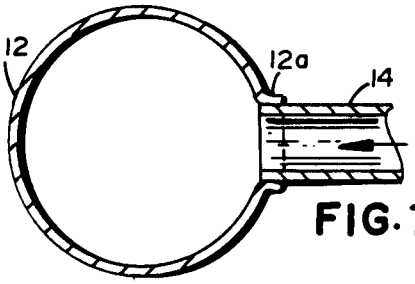
FIG. 7 is an enlarged sectional view of an inserted portion of one runner, a nipple and the adjacent body area taken on plane VII—VII of FIG. 2.

The hollow body is here shown to include two nipples 12*a* and 12*b* formed in accordance with the present invention. The number of nipples and runners will vary with the use of the manifold. Runners 14 and 16 are inserted into and lap welded to nipples 12*a* and 12*b* respectively. The insertion of a runner into a nipple of the body is shown in FIG. 7 for runner 14 within nipple 12*a* of body 12. Following the insertion to form the lapped interfit, peripheral welds 26 and 28 are formed around the runner exteriors at the juncture with the nipples around runners 14 and 16. Runner 18 is also welded in the end of the body at peripheral weld 30.

Figure 3:
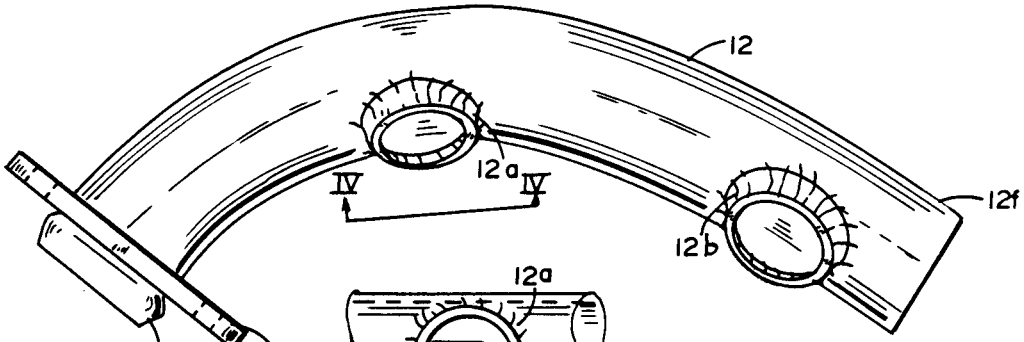
FIG. 3 is a perspective view of the body in FIG. 2.
Figure 4:
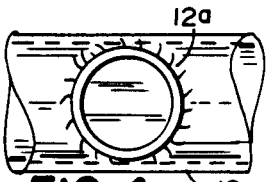
FIG. 4 is a fragmentary view taken on plane IV—IV of FIG. 3.
Figure 5:
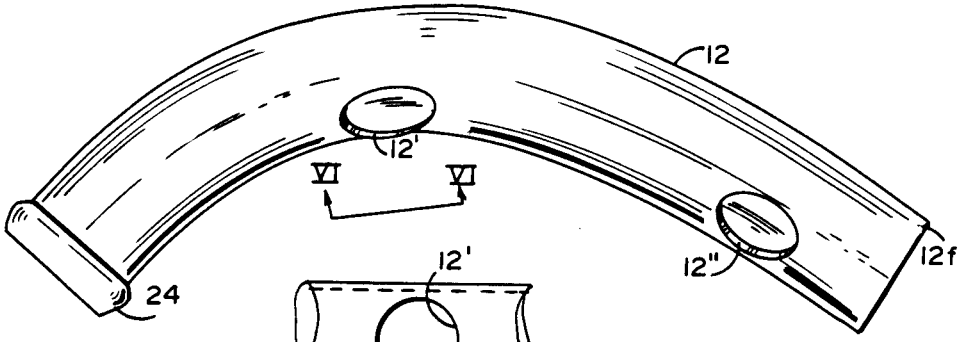
FIG. 5 is a perspective view of the manifold body in FIGS. 1-3 prior to nipple formation.
Figure 6:
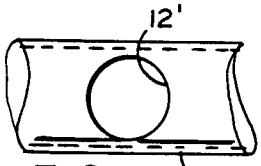
FIG. 6 is a fragmentary view taken on plane VI—VI of FIG. 5.

In forming this assembly, tubular body 12 of stainless steel is formed into a configurated curvilinear structure such as that depicted in FIG. 5. Subsequently, the desired number of oval-shaped, oblong openings 12′ and 12″, here shown to be two in number, are cut into the body at particular locations in its periphery. These are shown angularly displaced as well as linearly displaced relative to each other. Optimum manifold design for various style and size engines requires placement and orientation of the runners at various locations and angles. Those depicted are merely exemplary. These openings are laser cut, using for example the teachings of U.S. Pat. No. 4,644,128 issued Feb. 17, 1987 and assigned to the assignee herein. The major axis of the oval opening is aligned with the main dimension of the body while the minor axis is transverse so that, when a circular die forms the subsequent nipple thereat, the peripheral wall portions of the nipple will have generally the same height In FIGS. 3-5, the body 12 with nipples 12*a* and 12*b* formed integrally therein to protrude transversely to the main axis thereof is shown. Prior to formation of the nipples, connector plate 22 is slid over the length of the body to abut against annular swaged shoulder 24. Following formation of the nipples, the opposite open end 12*f* of body 12 is swaged or rolled down to an appropriate size to receive runner 18 with a sliding fit.

Figure 8:
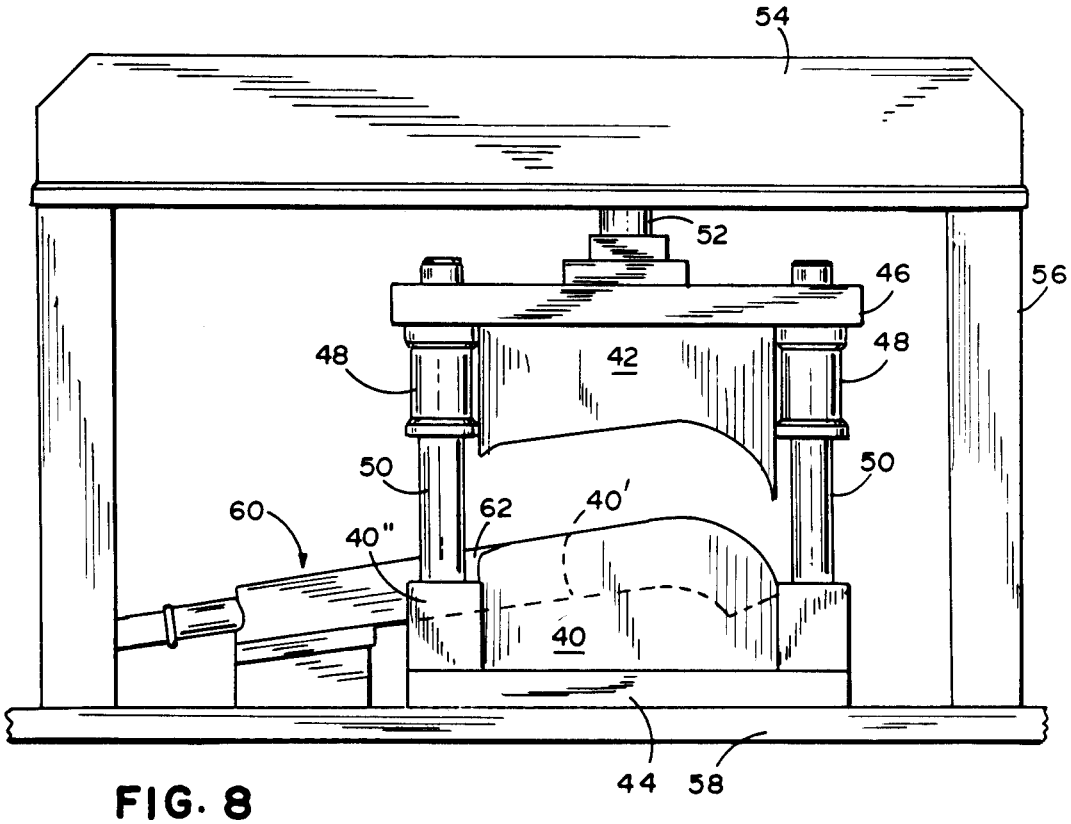
FIG. 8 is an elevational view of the forming apparatus including the press.
Figure 2:
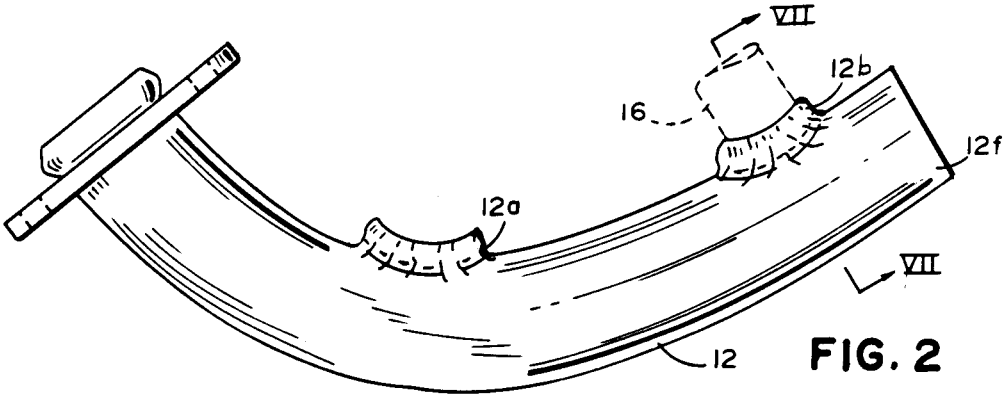
FIG. 2 is an elevational view of the body or log of the manifold in FIG. 1, showing nipples formed according to this invention.

In FIG. 8 is depicted an illustrative apparatus of the preferred type for enabling the nipple forming operation to be performed. A pair of dies, including a lower die 40 and an upper die 42, are cooperably movable, preferably the upper die moving vertically relative to the lower die such that when the upper die is raised, the manifold body 12 can be inserted and then clamped by lowering the upper die. These dies are configurated to match that of the manifold body. The lower die is shown to include a configurated cavity 40′ to receive this body. Die cavity 40′ has an open end 40″ (FIG. 8) for axial insertion of a mandrel assembly into the manifold body as described hereinafter.

These dies are mounted to a pair of platens, i.e. a lower fixed platen 44 and an upper movable platen 46. Upper platen 46 has slide bearings 48 at its four corners, cooperatively slidably interfitted with closely fitting vertical fixed guides 50 for up and down movement. Upper platen 46 is suspended on the lower end of a press actuator rod 52 extending from a typical heavy duty fluid cylinder or the like secured to beam 54. This beam is mounted on a plurality of pillars 56 affixed to bed plate 58. Platen 44 is also affixed to bed plate 58. Optionally, this entire assembly is elevated above the floor level by mounting on a suitable support structure (not shown) to be at optimum working height.

Mandrel assembly 60 (FIGS. 8, 9 and 10) includes a main mandrel body 62 and a mandrel extension bullet 64 (FIG. 9), if required, attached in articulated fashion to the main body by articulated joint 6 to be described. This articulated mandrel assembly thus will follow the curvilinear configuration of the manifold body without binding or distortion, enabling nipples to be formed on selected portions of the body at desired angles therefrom using dies supported by the mandrel assembly.

Figure 10:
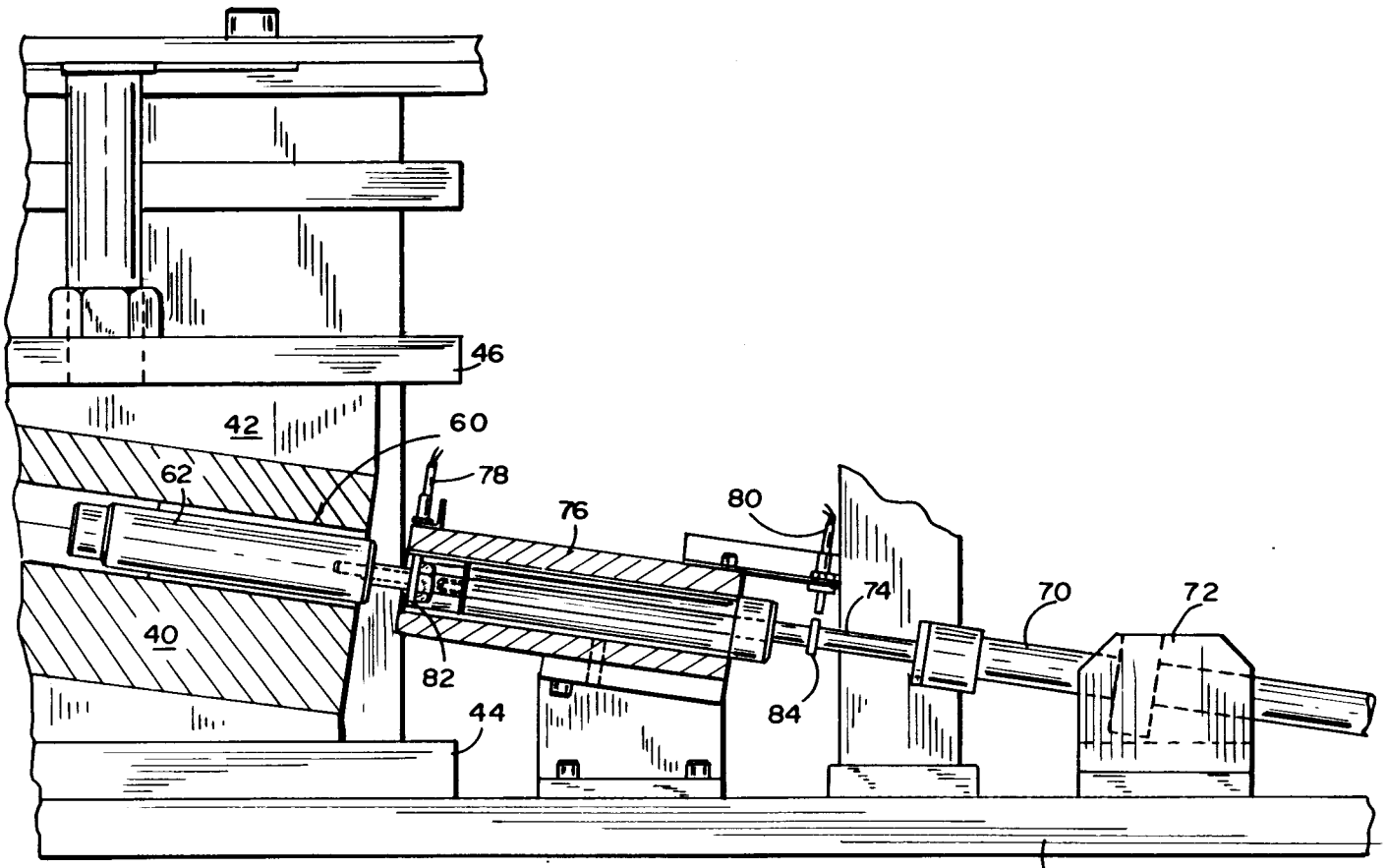
FIG. 10 is an elevational view of the mandrel and other forming components of the apparatus in FIG. 9.
Figure 11:
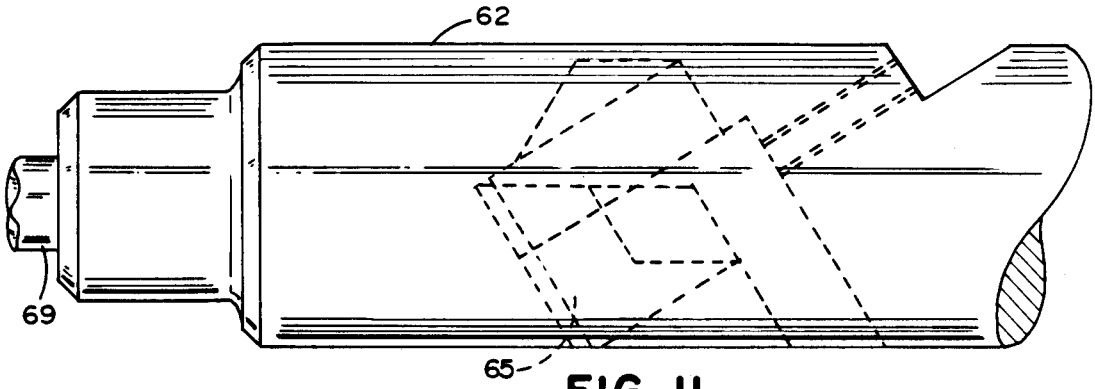
FIG. 11 is an elevational fragmentary view of the mandrel main body with one forming die cavity therein.
Figure 12:
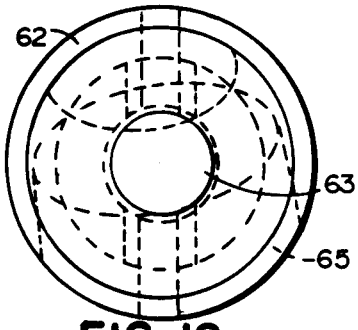
FIG. 12 is an end view of the main body in FIG. 11.
Figure 13:
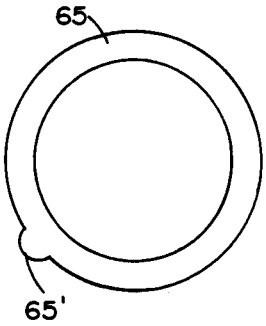
FIG. 13 is an elevational view of the cavity in FIG. 11.
Figure 14:
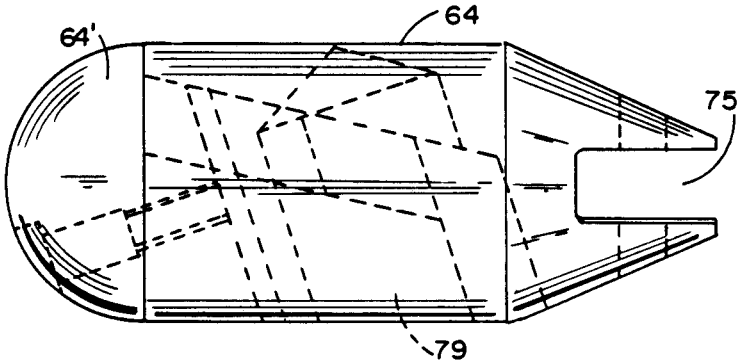
FIG. 14 is an elevational view of the articulated mandrel extension or bullet.
Figure 15:
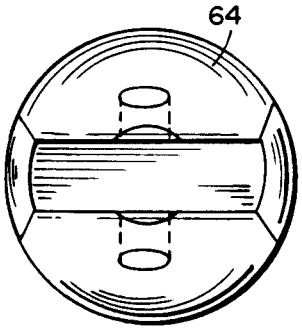
FIG. 15 is an end elevational view of the mandrel extension in FIG. 14.
Figure 16:
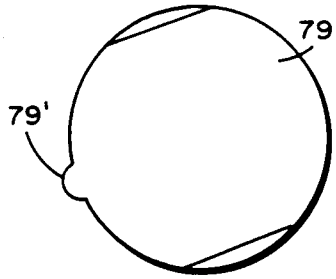
FIG. 16 is an elevational view of the die cavity in FIG. 14.

Axial movement of the mandrel assembly is achieved using an actuator 70 such as a fluid cylinder mounted by brackets 72 to bed plate 58, the extended piston rod 74 of this actuator extending through a housing 76 for the mandrel (FIG. 10). The amount of insertion or retraction of this mechanism can be controlled in a suitable manner such as by a pair of limit switches 78 and 80 cooperative with collars 82 and 84 on the piston rod 74.

In the depicted form of the invention, each of the mandrel components incorporates one forming die. Each forming die is operably associated with a transversely oriented transfer actuator, rotary actuator, and forming actuator, depicted in FIG. 9 and described more fully hereinafter. For purposes of clarity, the details of the mandrel assembly and the forming die arrangement will first be described.

Figure 17:
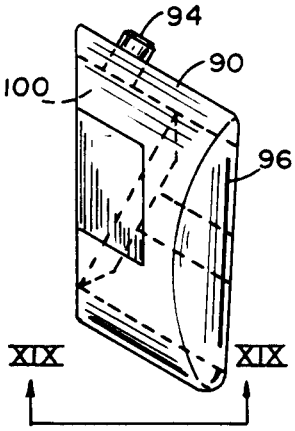
FIG. 17 is a side elevational view of a forming die.
Figure 18:
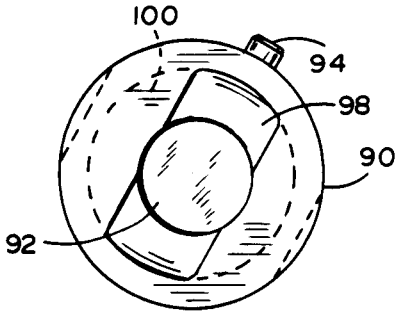
FIG. 18 is an end view of the forming die in FIG. 17.
Figure 19:
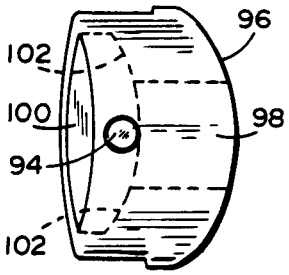
FIG. 19 is another side view of the forming die in FIGS. 17 and 18, taken on plane XIX—XIX of FIG. 17.

Referring now to FIGS. 11–13 and 14–16, a preferred form of the mandrel main body and mandrel extension are there respectively depicted. In FIGS. 17–19 is illustrated a typical forming die. The mandrel main body 62 (FIGS. 11–12) comprises an elongated, generally cylindrical member having a threaded recess 63 (FIG. 12) at one end for attachment to rod 74. Along the length of this component is one or more (here shown to be one) cylindrical die-receiving cavities 65 of circular cross sectional configuration. This cavity has an elongated axial keyway 65' along its wall to interfit with an appropriate cooperating key on the die, to prevent rotation of the die within the cavity. The axis of cavity 65 is at an acute angle to the longitudinal axis of mandrel body 62. This angle may be varied as desired from a small acute angle up to a 90 degree angle, depending upon the desired angle of the nipple to be formed relative to the adjacent axial orientation of the manifold body. Forming one portion of the articulated joint 66 of the mandrel assembly is a swivel pin 67 (FIG. 11) formed in an extension 69 of smaller diameter than mandrel body 62.

Cooperatively connected with this main body 62 is the mandrel extension 64. Its leading axial end 64' is hemispherical in configuration to follow smoothly through the curvilinear surface of the manifold body. Its trailing end is bifurcated, forming a receiving slot 75 to receive extension 69 interconnecting the two parts of the mandrel.

This mandrel extension also is shown to include a forming die cavity 79, with a key slot 79'. This forming cavity is also at an acute angle to the main axial dimension of mandrel component 64, the particular angle being that desired for the orientation of the nipple to be formed on the portion of the manifold body at that location.

The particular die to be employed in each of the mandrel cavities, e.g. cavity 65 in the main body portion or cavity 79 in the extension, is constructed to have its axial orientation, i.e. direction of movement during the forming operation, to match that of the cavity in which it is placed. The die in FIGS. 17–19 has a circular cross section on a plane perpendicular to its axis of movement. This die 90 thus, when viewed along its axis 92, has a circular configuration (FIG. 18) from which key 94 extends laterally for insertion into the keyway of the cavity. The cylinder is canted so that its leading edge and following edge will be aligned with the periphery of the mandrel. When the die is fully inserted into the cavity, it will not protrude past the mandrel outer periphery. The leading face of the die is a forming face 96. This forming face has a convex curvature of the same general curvature as the cylindrical surface of the mandrel into which it is recessed and thus of the manifold body since the mandrel is just slightly smaller in diameter than the manifold body. An elongated slot 98 extends inwardly along the axis of the die, this slot being shown to be of generally rectangular configuration. This slot leads to an inner recess 100 within the inner end of the die. This generally cylindrical recess forms a pair of shoulders 102 on opposite sides of the elongated slot. These shoulders will interfit with a pair of shoulders on the male interlock member depicted in FIGS. 20–21 and to be described.

Figure 21:
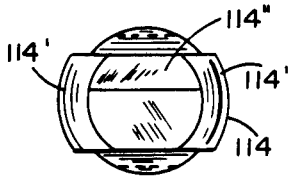
FIG. 21 is an end view of the male interlock member.
Figure 20:
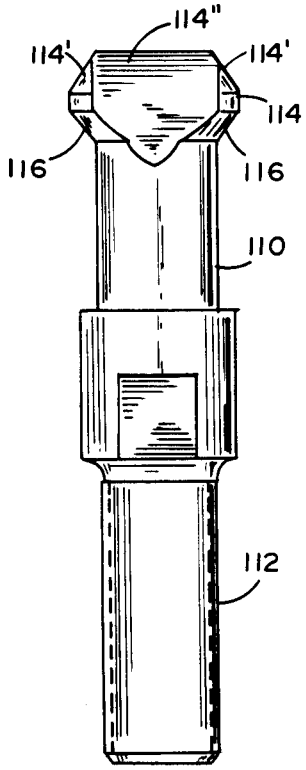
FIG. 20 is a side elevational view of the male interlock member.

The drawing rod 110 in FIGS. 20 and 21 includes a threaded end 112 or the equivalent for attachment to an actuator collar to be described hereafter. The opposite end of the rod is an insert end with a head 114 enlarged in one lateral dimension so as to be elongated and form a pair of opposite tapered shoulders 116 for interconnection with the tapered shoulders of the female member of the die just described. The inner portions of this head are preferably tapered at 114' for smooth insertion. Likewise, the opposite sidewalls 114'' are tapered. The smaller width dimension of this head is slightly less than the width of slot 98 while the greater width dimension with its curvilinear ends is slightly smaller than the length of slot 98. Thus, the male head member can be inserted into the slot until it is positioned within recess 100, and then rotated to cause shoulders 116 to engage with shoulders 102 of the die. Forceful retraction of the rod will then cause the die to retract with it to form a nipple in a manner to be explained in more detail hereinafter.

Figure 9:
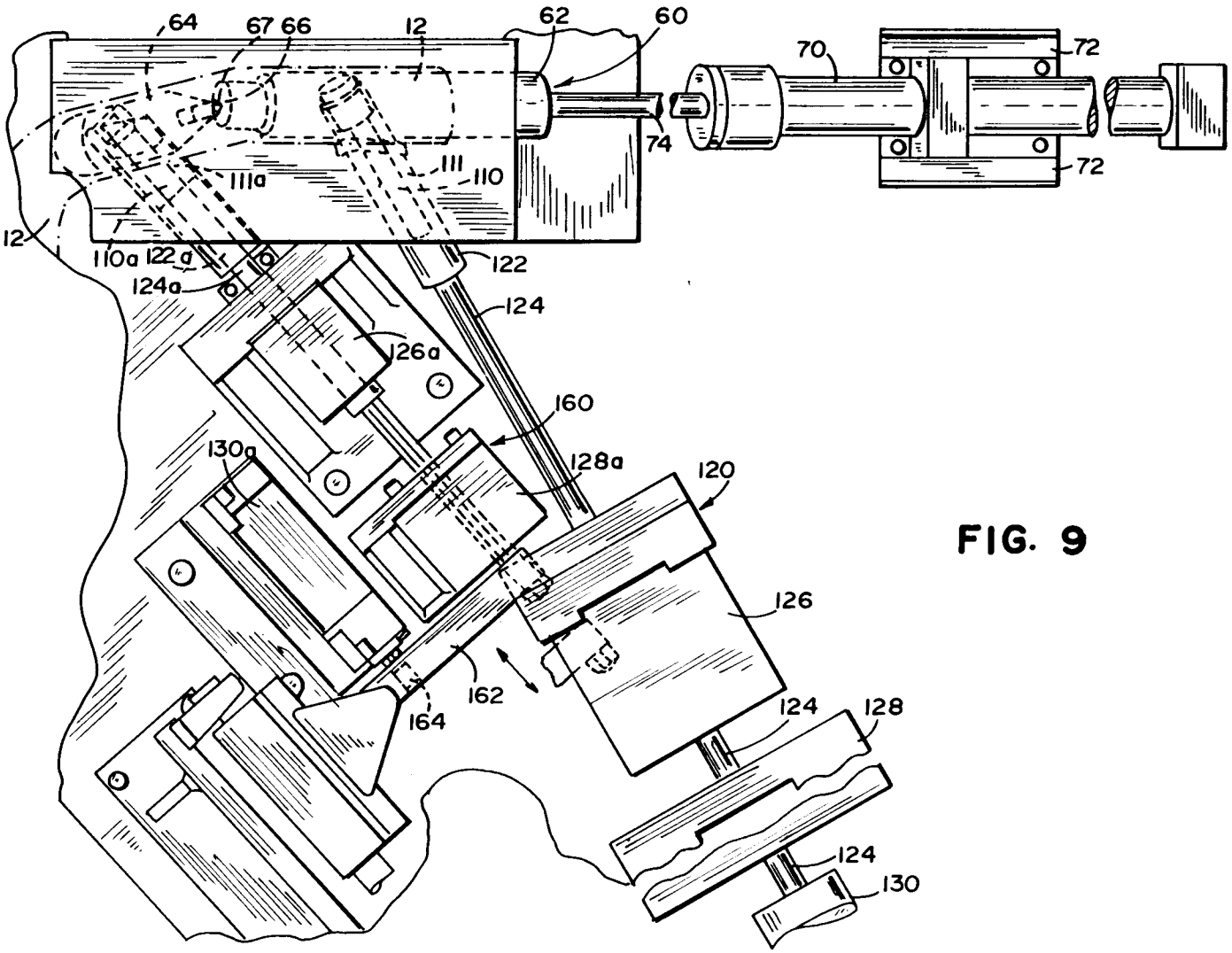
FIG. 9 is a plan view of the mandrel and other forming components in the apparatus of FIG. 8.

Selective movements of the drawing rod and die are achieved with the transfer actuator, rotary actuator and forming actuator depicted in FIG. 9. In FIG. 9 there are two slightly different versions of the actuator assemblies shown. Specifically, actuator assembly 12 has all of the actuators colinear with each other. However, assembly 160 has one of the actuators, namely the transfer actuator, offset from the axis of the other two. In both instances, however, all three actuators operate through the same drawing rod to operate a forming die. In some instances during use of other embodiments of the present invention, the actuator assemblies can all be coaxial. In this particular illustrated embodiment, however, where the angle of one assembly relative to the other one is such that there could be overlapping interference between them, this offset arrangement is beneficial.

The actuator assembly 120 in this instance is shown to be cooperative with the forming die in the main mandrel body 62, while actuator assembly 160 is shown to be cooperative with the forming die in the mandrel extension 64.

Referring first to assembly 120, drawing rod 110 is shown threadably connected to its collar 122 secured to the end of shaft 124. This cylinder shaft extends through the length of forming actuator 126, a fluid cylinder, which has a conventional internal annular piston (not shown) surrounding the shaft. The purpose of cylinder 126 is to withdraw shaft 124 and subsequently return it in the opposite direction. Such cylinders are available from cylinder manufacturers. This cylinder 126 is affixed to be rigid. Rod 124 also extends through rotary actuator 128 which can be of a standard fluid actuator type, or alternatively a gear and rack mechanism or the equivalent, the purpose being to rotate shaft 124, collar 122 and drawing rod 110 a limited amount, normally about 90 degrees, in one direction and then the other. Shaft 124 extends through rotary actuator 128 and into fluid cylinder 130 serving as the transfer actuator. This fluid cylinder has a smaller diameter piston so as to have less total force than that of forming actuator 126, but has a greater throw length. Thus, it can move the drawing rod totally into or out of engagement with the die and mandrel.

By way of brief explanation of this assembly in operation, therefore, transfer actuator 130 shifts shaft 124 to cause rod 110 to be inserted into the die recessed in the mandrel. Then rotary actuator 128 rotates shaft 110 to engage the male member shoulders with the female member shoulders of the die. Then forming actuator 126 withdraws the rod and die to form the nipple, after which these operations are reversed in inverse sequence.

Referring now to assembly 160, again drawing rod 110*a* is connected to a collar 122*a* on shaft 124*a*. Shaft 124*a* extends through a forming actuator 126*a* of fluid cylinder type, then through a rotary actuator 128*a*, all in axial alignment. The extended end of rod 124*a* protruding from the rear of rotary actuator 128*a* is secured to a solid transverse coupling plate 162 also connected to the extended rod 164 of a transfer actuator cylinder 130*a* mounted off to the side of the rotary actuator. All of the actuators are fixedly mounted and all operate shaft 124*a* and drawing rod 110*a*.

In operation of the depicted apparatus, therefore, to form the stainless steel manifold having a curvilinear configurated body 12 so as to form nipples 12*a* and 12*b* thereon, the body depicted in FIG. 5 is placed between dies 40 and 42, and specifically in cavity 40' so that the open end 12*f* of body 12 is oriented toward the mandrel insertion assembly 60. Upper die 42 is then lowered to the lower die to secure the manifold body in place, with the precut openings 12' and 12'' aligned with appropriate laterally oriented openings in die 40 oriented toward the actuator assemblies. Mandrel actuator 70 is then extended to cause rod 74 (FIG. 9) to extend articulated mandrel assembly 60 axially into the open end 12*f* of configurated body 12 until the dies in the mandrel members are aligned with precut openings 12' and 12'' as well as lateral channels 111 and 111*a* (FIG. 9) in retention die 40. The manifold is then in position for nipple formation. At that point, transfer actuators 130 and 130*a* are activated. Actuator 130 is extended to cause shaft 124 to move drawing rod 110 through opening 12'' sufficiently to move head 114 of drawing rod (FIG. 20) through slot 98 of the die into inner recess 100. Transfer actuator 130*a*, on the other hand, because of its orientation, contracts to draw its rod 164 and thereby move drawing rod 110*a* through opening 12' in body 12 to cause the head on the drawing rod to be extended into the recess of this die in the mandrel extension 64. With the two heads 14 of the drawing rods inserted thusly, rotary actuators 128 and 128*a* are activated, causing shafts 124 and 124*a* to be rotated 90 degrees. This moves shoulders 116 (FIG. 20) into locking engagement with shoulders 102 of the forming dies. Subsequently, forming actuators 126 and 126*a* are activated to withdraw shafts 124 and 124*a* a controlled amount and thus withdraw the forming dies from the mandrel portions, into forced engagement with the peripheral portions surrounding the oval openings 12' and 12'' of the manifold body to create the cylindrical nipples. This movement of these powerful forming actuators 126 and 126*a* is against the force of the transfer actuators 130 and 130*a* and, due to greater force output of the former compared to the latter, forces the transfer actuators a short distance in reverse during this nipple formation. The resulting nipples are basically cylindrical with a substantially circular cross section. Then the actuators are reversed in inverse sequence. Forming actuators 126 and 126*a* are first reversed to shift the forming dies back into the mandrel recesses. The rotary actuators 128 and 128*a* are then reversed to rotate drawing rods 110 and 110*a* in reverse through the 90 degree angle to release them from the drawing dies. Then transfer actuators are reversed to withdraw the drawing rods from the mandrels and beyond the periphery of manifold body 12.

Next, mandrel shifting actuator 70 is reversed to withdraw the articulated mandrel with its forming dies from the body of the manifold. Upper die 42 and upper platen 46 of the press are then elevated to free the manifold body with its newly formed nipples. The part is removed for subsequent operations. In these subsequent operations, the open end 12*f* of the manifold body is crimped as by a standard I/O machine to reduce its diameter to receive runner 18 with a smooth inner fit. Also runners 14 and 16 are inserted into the nipples 12*a* and 12*b*. These three runners are then peripherally welded into place with a lap weld. The resulting lap weld construction has been found to be an excellent structure for minimizing stresses at these connections even at high temperatures.

As indicated previously, the particular number of nipples which can be formed is optional, as well as the particular acute angles of orientation relative to the various parts of the manifold body. The manifold construction can thus be varied to accommodate the particular design and size desired to fit particular makes and models of vehicles. The air flow which passes through the runners and then into the body is relatively smooth so as to avoid creating excessive hot spots due to turbulence at the welded junctures. The lapped welds are stronger and more uniformly formable than butt welded assemblies.

Figure 22:
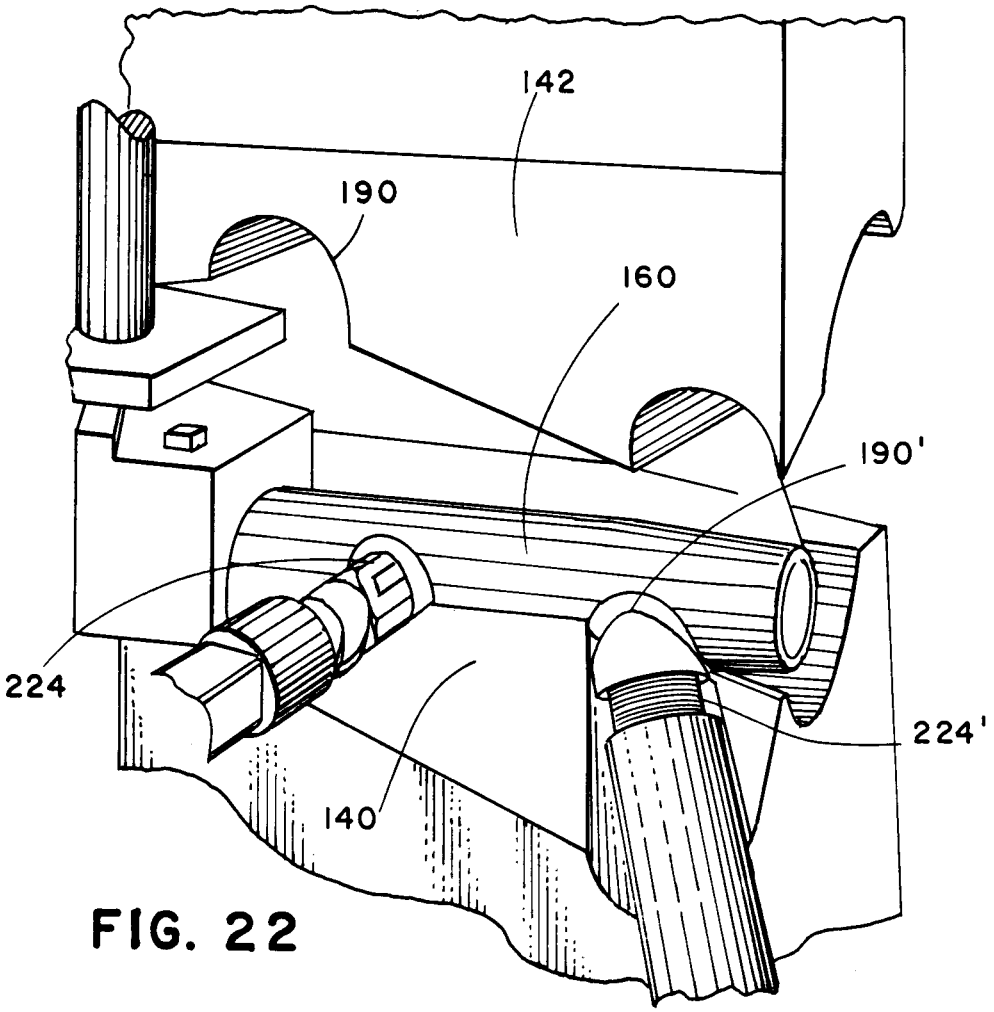
FIG. 22 is a fragmentary perspective view of an alternative forming apparatus to that in FIGS. 8-15, utilizing a solid mandrel.

Also, a single mandrel rather than an articulated mandrel can be used on certain manifold bodies. More specifically, referring to FIG. 22, the forming apparatus there shown has a solid cylindrical single axis mandrel with a somewhat tapered nose. The mandrel is shown inserted into the retention die assembly which is shown in the open condition. The mandrel is retractable out of the retention die cavity when a tubular workpiece is loaded into the die cavity and the press is then closed. A tubular workpiece is not depicted here so that the mandrel and its pair of laterally extensible forming dies can be clearly seen. As in the previously described apparatus, this apparatus includes upper and lower platens supporting upper and lower retention dies 142 and 140 defining a cavity to receive and retain the tubular workpiece. Extensible axially into the workpiece is a solid one-piece mandrel 160. Mandrel 160 is shifted lengthwise into and out of the cavity by a fluid actuator or the like as before. In laterally opening cavities of mandrel 160 are shown two cylindrical forming dies 190 and 190' of comparable configuration to those previously described and interlockable with pull rods as previously described These are movable transversely of the mandrel axis by the interconnecting pull rods 224 and 224' to create nipples. These dies are movable outwardly and inwardly of the mandrel on axes which are shown at an acute angle to the mandrel axis, at an acute angle with respect to each other, and at a rotational angle to each other. The actuating pull rods 224 and 224' and their respective transfer, rotary and forming actuators are axially aligned with the forming dies at an acute angle with respect to each other. The forming operation by these components is comparable to that in the description of the first embodiment. The novel apparatus actually enables two or more forming dies to effectively draw nipples at different acute angles along the length of a manifold body.

Those skilled in this art, upon studying this disclosure, might well envision other obvious variations within the scope of the invention, to suit a particular type of installation or arrangement. Thus, the preferred embodiment of this invention described in detail is not intended to be limiting of the invention, which should be limited only by the scope of the appended claims and the reasonable equivalents thereto.

The embodiments of the invention in which an exclusive property or privilege is claimed are defined as follows:

1. Nipple drawing apparatus for forming a lateral nipple around a lateral opening in an elongated exhaust manifold tubular body comprising:

a mandrel for insertion axially into the tubular body, said mandrel having at least one generally cylindrical recess oriented transversely of said mandrel;

a forming die in said recess, movably guided by said recess to enable extension of said die transversely of said mandrel to form a nipple on the tubular body around said lateral opening;

a drawing rod for rotary interlock with said forming die;

rotary interlock means on said rod and said die for temporary interlock thereof and subsequent release thereof;

a transfer actuator connected to said drawing rod, axially actuable to transfer said rod toward said die into engagement with said die and subsequently away from said die for retracting said rod from said die;

a rotary actuator for said rod for actuating said rotary interlock means and thereby rotationally interlocking said rod to said die when engaged, and for subsequent rotational release therefrom; and a forming actuator connected to said rod, axially actuable in the opposite direction as the engagement direction of said transfer actuator, to move away from the tubular body, for forcefully drawing said rod and die away from the tubular body to form the nipple, and then toward the tubular body to return the die.

2. The nipple drawing apparatus in claim 1 wherein said forming actuator overcomes the force of said transfer actuator during the nipple forming actuation.

3. The nipple drawing apparatus in claim 1 wherein said transfer actuator is a fluid cylinder and said forming actuator is a fluid cylinder of shorter stroke and greater force than said transfer actuator.

4. The nipple drawing apparatus in claim 3 wherein said rod extends through said forming actuator fluid cylinder to said transfer actuator fluid cylinder 5. The nipple drawing apparatus in claim 1 including an actuator for extending said mandrel and die into the tubular body, and withdrawing said mandrel and die therefrom.

6. The nipple drawing apparatus in claim 1 wherein said die and rod rotary interlock means includes an oblong female member and a first pair of shoulders with a recess therebehind, and an oblong male member with a second pair of shoulders insertable into said female member and rotatable in said recess behind said first pair of shoulders to cause said pairs of shoulders to interlock.

7. The nipple drawing apparatus in claim 6 wherein said female member is in said die and said male member is on said rod.

8. The apparatus in claim 1 wherein said forming die and said recess have a keyed relationship therebetween to prevent rotation of said die in said recess.

9. The apparatus in claim 1 wherein said rotary actuator is rotationally movable in one direction to interlock said rod and die, and in the opposite direction to release said rod and die.

10. Nipple drawing apparatus for forming nipples around lateral openings in an elongated exhaust manifold tubular body having body portions at an angle to each other comprising:

a mandrel for insertion axially into the tubular body, said mandrel having portions and at least one generally cylindrical recess in each said mandrel portion oriented transversely of said respective mandrel portion;

a forming die in each said recess, movably guided by said respective recess to enable extension of said die transversely of said respective mandrel portion to form a nipple on the tubular body around said lateral opening;

said respective forming dies in said respective recesses being oriented and movable at an angle with respect to each other;

a drawing rod for interlock with each said forming die;

interlock means on said rods and said respective dies for temporary interlock thereof and subsequent release thereof;

a transfer actuator connected to each said pulling rod, axially actuable to transfer said rod toward said die into engagement with said die and subsequently away from said die after the forming step for retracting said rod from said die;

a forming actuator connected to each said rod, axially actuable in the opposite direction as the engagement direction of said respective transfer actuator, to move away from the tubular body for pulling the respective rods and dies away from the tubular body to form the nipple, and then reverse to move toward the tubular body to return the respective dies;

said transfer actuator and forming actuator for said die or dies in one mandrel portion being at an angle to the die or dies in another mandrel portion.

11. Nipple drawing apparatus for forming a lateral nipple around a lateral opening in an elongated tubular body comprising:

fixture means for retaining a tubular body;

a mandrel for insertion axially into the tubular body, said mandrel having at least one generally cylindrical recess oriented transversely of said mandrel;

a forming die in said recess, movably guided by said recess to enable extension of said die transversely of said mandrel to form a nipple on the tubular body around said lateral opening;

a pulling rod for rotary interlock with said forming die;

rotary interlock means on said rod and said die for temporary interlock thereof and subsequent release thereof;

said die and rod rotary interlock means including an oblong female member with a first pair of shoulders and a recess therebehind, and an oblong male member with a second pair of shoulders insertable into said female member and rotatable in said recess behind said first pair of shoulders to interlock said pairs of shoulders;

a forming actuator connected to said rod, axially actuable away from the tubular body, for pulling said rod and die away from the tubular body to form the nipple, and then toward the tubular body to return said die.

12. Nipple drawing apparatus for forming nipples around lateral openings in an elongated exhaust manifold tubular body having body portions at an angle to each other comprising:

an articulated mandrel for insertion axially into the tubular body, said mandrel having elongated portions connected by an articulated joint to be movable with respect to each other, and at least one recess in each said mandrel portion oriented transversely of said respective mandrel portion;

a forming die in each said recess, movably guided by said respective recess to enable extension of said die transversely of said respective mandrel portion to form a nipple on the tubular body around said lateral opening;

said respective forming dies in said respective recesses being oriented and movable at an angle with respect to each other;

a drawing rod for interlock with each said forming die;

a forming actuator connected to each said rod, axially actuable to move away from the tubular body for pulling the respective rods and dies away from the tubular body to form the nipple, and then reverse to move toward the tubular body to return the respective dies;

said forming actuator for said die or dies in one mandrel portion being at an angle to the die or dies in another mandrel portion.

* * * * *

UNITED STATES PATENT AND TRADEMARK OFFICE

CERTIFICATE OF CORRECTION

PATENT NO. : 4,798,076

DATED : January 17, 1989

INVENTOR(S) : Donald R. Rigsby et al

It is certified that error appears in the above-identified patent and that said Letters Patent is hereby corrected as shown below:

In the Abstract, Line 1;
"extension" should be -- extrusion --;

Column 4, line 55;
"joint 6" should be -- joint 66 --;

Column 7, line 46;
The numeral "14" should be -- 114 --.

Signed and Sealed this

Seventh Day of November, 1989

*Attest:*

JEFFREY M. SAMUELS

*Attesting Officer*

*Acting Commissioner of Patents and Trademarks*